US008057190B2

(12) United States Patent
Reinschke

(10) Patent No.: US 8,057,190 B2
(45) Date of Patent: Nov. 15, 2011

(54) METHOD AND CONTROL UNIT FOR OPERATING A LINEAR COMPRESSOR

(75) Inventor: Johannes Reinschke, Nürnberg (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 665 days.

(21) Appl. No.: 12/224,516

(22) PCT Filed: Jan. 23, 2007

(86) PCT No.: PCT/EP2007/050635

§ 371 (c)(1),
(2), (4) Date: Nov. 19, 2008

(87) PCT Pub. No.: WO2007/113015

PCT Pub. Date: Oct. 11, 2007

(65) Prior Publication Data

US 2009/0155089 A1 Jun. 18, 2009

(30) Foreign Application Priority Data

Feb. 28, 2006 (DE) ..... 10 2006 009 231

(51) Int. Cl.
*F04B 49/06* (2006.01)
*G05B 15/00* (2006.01)

(52) U.S. Cl. ..... 417/44.1; 417/44.11; 417/53

(58) Field of Classification Search ..... 417/53, 417/18, 44.1, 44.11; 700/275; 318/632, 318/119, 127, 135
See application file for complete search history.

(56) References Cited

U.S. PATENT DOCUMENTS

| | | | |
|---|---|---|---|
| 6,596,032 | B2 | 7/2003 | Nojima et al. |
| 6,642,377 | B1 | 11/2003 | Kayano et al. |
| 2002/0064462 | A1 | 5/2002 | Park et al. |

FOREIGN PATENT DOCUMENTS

| | | |
|---|---|---|
| EP | 0 909 896 | 4/1999 |
| KR | 2002-0021532 | 3/2002 |
| WO | WO 2004/033909 | 4/2004 |

OTHER PUBLICATIONS

International Search Report PCT/EP2007/050635.

*Primary Examiner* — Karabi Guharay
*Assistant Examiner* — Elmito Breval
(74) *Attorney, Agent, or Firm* — James E. Howard; Andre Pallapies

(57) ABSTRACT

A control unit for a linear compressor comprises a current sensor for detecting the current consumption of the linear compressor, a deflection sensor for detecting the deflection of the linear compressor and a control circuit for controlling the movement and detecting an overload state of the linear compressor using the current consumption which is detected by the current sensor and the deflection which is detected by the deflection sensor.

10 Claims, 3 Drawing Sheets

METHOD AND CONTROL UNIT FOR OPERATING A LINEAR COMPRESSOR

The present invention relates to a method and a control unit for operating a linear compressor, in particular for use to compress coolant in a cooling device.

BACKGROUND OF THE INVENTION

Such linear compressors are, for example, known from U.S. Pat. Nos. 6,596,032 B2 or 6,642,377 B2.

During the operation of a compressor in a cooling device, situations may occur where the electrical power consumption of the compressor is unusually high and may lead to intense heating of the compressor. This may be the case, for example, when initially starting up the cooling device and/or after a lengthy stoppage time when the temperature of the entire interior of the cooling device has to be cooled down from a high initial temperature to a set operating temperature and the compressor has to be operated over a lengthy period of time without interruption, when, for example, due to a door not correctly closing, the flow of heat into the interior of the cooling device is increased, when the heat output from the condenser of the cooling device is hindered or when the movement of the compressor itself is disrupted by a mechanical defect. Such situations have to be reliably identified in order to limit the power consumption of the compressor, so that there is no fire risk as a result of overheating the compressor. In conventional cooling devices with a rotatably driven compressor, this object is generally achieved by means of a temperature sensor which is attached to the housing of the compressor, and a control circuit which, using the measured values supplied by the temperature sensor, makes a decision about a possible reduction in the electrical power supplied to the compressor.

A method for operating a linear compressor is known from KR 2002 021532-A in which a decision is made, using the electrical current intensity consumed by the compressor, as to whether the compressor is in an overload state or not, and the stroke of a piston of the compressor is reduced when an overload state is established.

As only the current consumption is used to decide whether an overload state is present or not, the limit value of the current consumption, above which an overload state is established, has to be sufficiently low that overheating is reliably avoided, even in possibly the most unfavorable operating conditions. The limit value has to be selected, therefore, such that overheating is eliminated even during long-lasting continuous operation of the compressor, such as when starting up the cooling device from a warm state. Operation at higher current intensities, which could be permitted without reservation during intermittent operation, when only a low temperature has to be maintained inside the cooling device, is thereby eliminated. The efficiency of the linear compressor is, therefore, not able to be fully utilized.

BRIEF SUMMARY OF THE INVENTION

It is the object of the invention to provide a method and a control device for operating a linear compressor which permit a more complete utilization of the efficiency thereof.

The object is firstly achieved in that, with a method for operating a linear compressor in which the current consumption of the linear compressor is detected, and using the current consumption, it is judged whether the linear compressor is in an overload state, and the motion amplitude of the linear compressor is reduced when the overload state of the linear compressor is established, the motion amplitude of the linear compressor is also detected and is used to judge whether the linear compressor is in an overload state.

The motion amplitude of the linear compressor may, in this respect, be relevant for the decision as to whether an overload state is present or not, as with the same current consumption the linear compressor is able to discharge the Joule heat released therein all the more efficiently to the outside, the more vigorously it moves.

Thus, according to the invention, to make a decision about the overload state, preferably a first limit value of the current consumption of the linear compressor is used which is established as an increasing function of the motion amplitude, and the overload state is established when said limit value is exceeded.

Similarly, the motion amplitude may also be established as an increasing function of the current consumption, and the overload state is established when the detected motion amplitude falls below the value of this function at the detected current consumption.

Expediently, in every case, the function is initially established such that the sum of the Joule heat output released in the linear compressor by the ohmic resistance thereof and the cooling capacity effected on the linear compressor by the motion thereof is substantially constant. In other words, the limit value effectively corresponds to a temperature of the linear compressor which is not intended to be exceeded in continuous operation.

Preferably, the motion amplitude of the linear compressor is reduced to a positive value when the overload state is established according to one of the criteria disclosed above, so that the linear compressor continues to operate at reduced power.

Moreover, the overload state may also be established when the motion amplitude falls below a second limit value, said second limit value being able to be established irrespective of the current consumption of the linear compressor and, if a first limit value of the motion amplitude as described above is used, being selected to be smaller than the first limit value, in order to detect the occurrence of mechanical immobilization of the linear compressor. When the overload state is detected under these conditions, the motion amplitude of the linear compressor is expediently reduced to zero.

In order to detect a mechanical defect, it may also be expedient to detect the deflection of the linear compressor in different phases of the oscillation thereof and to compare said deflection with a set motion sequence, and to establish the overload state when the deviation of the detected deflection from the set motion sequence exceeds a third limit value.

The object is further achieved by a control device for a linear compressor which, in addition to a current sensor for detecting the power consumption of the linear compressor and a control circuit for controlling the motion of the linear compressor using the detected current consumption, has a further sensor connected to the control circuit for detecting the deflection of the linear compressor, preferably the control circuit being designed to perform a method as disclosed above.

BRIEF DESCRIPTION OF THE DRAWINGS

Further features of the invention are revealed from the following description of exemplary embodiments with reference to the accompanying figures, in which.

DETAILED DESCRIPTION OF THE PRESENT INVENTION

Figure 1:
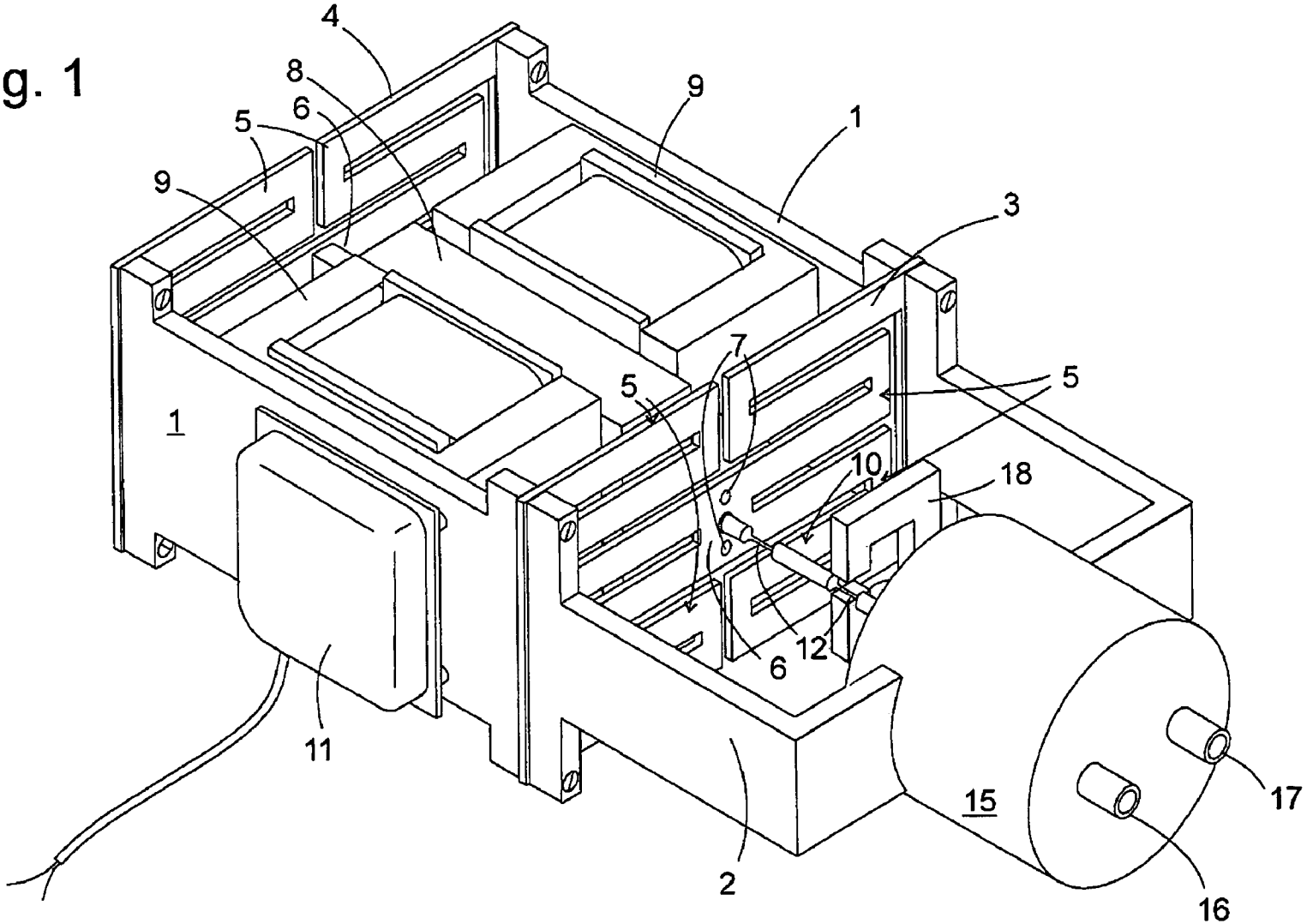
FIG. 1 shows a perspective view of a first embodiment of a linear compressor comprising a control device according to the present invention.

The linear compressor shown in FIG. 1 in perspective view, has a rigid frame, approximately U-shaped in plan view, which is made up of three parts, namely two planar wall pieces 1 and an arched portion 2. A first membrane spring 3 is stretched between the front faces of the arched portion 2 facing one another and the two wall pieces 1, and a second membrane spring 4 of the same construction as the membrane spring 3 is fastened to front faces of the wall pieces 1 remote from the arched portion 2.

The membrane springs 3, 4, stamped from spring steel sheet, have respectively four spring arms 5 which extend in a zigzag manner from the wall pieces 1 toward a central portion 6, where they meet. The central portion 6 has respectively three bores, two outer bores, on which a permanent magnetic oscillating body 8 is suspended by means of screws or rivets 7, and a central bore, through which, in the case of the membrane spring 3, a piston rod 10 extends fastened to the oscillating body 8, for example by a screw connection. The piston rod 10 connects the oscillating body 8 to a piston, not visible in the figure, in the inside of a pumping chamber 15 which is borne by the arched portion 2. The coolant inlet and outlet pipes of the pumping chamber 15 are denoted by 16 and/or 17.

Two electromagnets 9 with an E-shaped yoke and a coil wound about the central arm of the E-shape are respectively arranged between the oscillating body 8 and the wall pieces 1 with pole shoes facing the oscillating body and are used for driving an oscillating motion of the oscillating body.

A control circuit 11 for controlling the excitation of the electromagnets 9 is mounted on one of the wall pieces 1. The control circuit 11 may, for example, comprise an inverter which delivers a sine-shaped excitation current at a frequency adapted to the natural frequency of the oscillating body 8, and of variable voltage amplitude adapted to the electromagnets 9, or delivers to said electromagnets voltage pulses of a fixed voltage amplitude but variable pulse duty factor. In every case, the control circuit 11 controls via the voltage amplitude or the pulse duty factor the average current intensity of the current consumed by the electromagnets 9 and thus the power thereof.

The control circuit 11 uses a current sensor which is built-in, and thus not visible in the figure, for detecting the flow of current through the coils of the electromagnets 9 and said control circuit is connected to a position sensor 18 for time-resolved detection of the position of the oscillating body 8. The position sensor 18 in this case comprises an electromagnet of C-shaped design, the piston rod 10 extending between the two pole shoes thereof facing one another. The position sensor 18 is shielded by the metal membrane spring 3 against scatter fields of the electromagnets 9. One of two tapered portions 12 of the piston rod 10 is located level with the pole shoes of the position sensor 18. The piston rod 10 is resiliently flexible in the tapered portions in order to compensate for possible alignment errors as a result of manufacturing tolerances between the movement of the oscillating body 8, on the one hand, and that of the piston in the pumping chamber 15, on the other hand. The effective width of the air gap between the pole shoes of the position sensor 18 varies according to how far the one tapered portion 12 is immersed between the pole shoes. Accordingly, the inductance of the winding of the electromagnet and thus the frequency of an electrical oscillating circuit into which the winding is incorporated varies. This frequency, which is substantially greater than the natural frequency of the oscillating body 8, thus forms a measurement of the deflection thereof, which is processed by the control circuit 11.

The position sensor 18 disclosed above may be replaced by any other type of position sensor, which is able to deliver time-resolved measured values of the position of the oscillating body 8. Thus in FIG. 2 a modified embodiment of a linear compressor according to the invention is shown, in which instead of a magnetic position sensor, an optical position sensor 18 is provided. Said optical position sensor comprises a plate 19 fixedly connected to the oscillating body 8 and made of a transparent material, on which opaque strips are arranged at regular intervals extending transversely to the direction of movement of the oscillating body 8. The plate consists of glass or a synthetic material resistant to the coolant pumped in the pumping chamber 15.

On the yoke of one of the electromagnets 9, two light sources, such as for example light-emitting diodes, are mounted in a housing which transmit a bundled light beam to two photo-diodes which are mounted in a housing 21 on the yoke of the other electromagnet 9. According to whether the light beams pass through the plate 19 or are blocked off by the strips, the photo-diodes deliver a bright signal level or dark signal level to the control circuit 11 which, using the number of level changes and the relative phase of the signals delivered by the two photo-diodes, follows the extent and direction of movement of the oscillating body 8.

The position information supplied by the position sensor 18 is evaluated by the control circuit 11 in two different processes.

Figure 3:
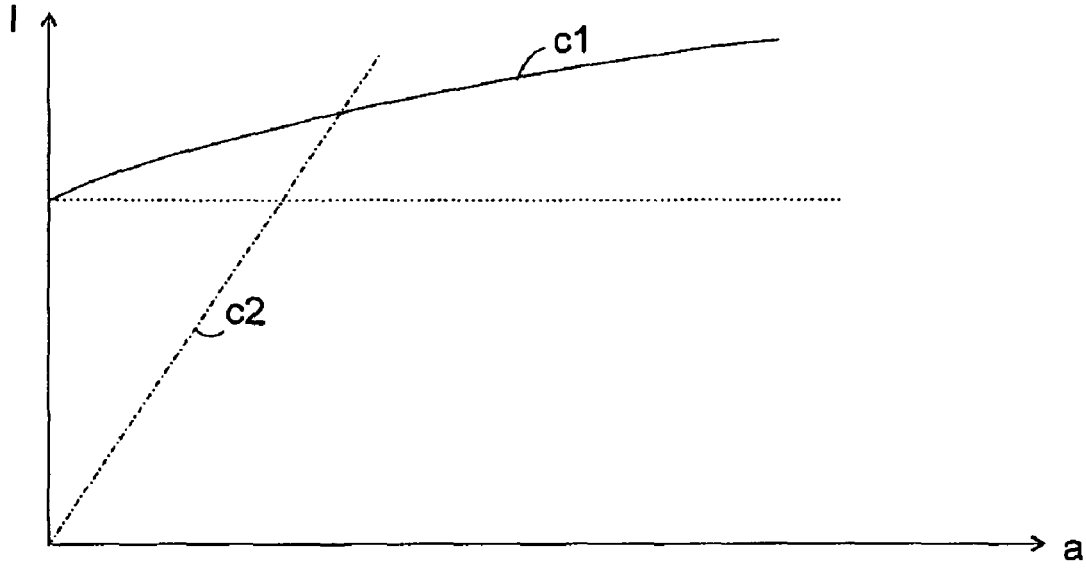
FIG. 3 shows a typical path of a limit value of the current consumption of the linear compressor of FIG. 1 or 2 as a function of the motion amplitude thereof.

The first process initially comprises a step of detecting the motion amplitude of the oscillating body 8 from the sequence of the position information supplied by the position sensor 18. In a second step, the critical current intensity value corresponding to the detected amplitude is read from a memory in which a critical current intensity is stored as a function of the motion amplitude. A typical path of the critical current intensity I as a function of the deflection a is represented in FIG. 3 by a curve c1. The critical current intensity at a given motion amplitude is defined as the current intensity which, during continuous operation at the relevant amplitude, i.e. in the thermal equilibrium between the electromagnets 9 and the surroundings thereof, produces a maximum permitted operating temperature of the windings from the Joule heat released from the flow of current through the windings, on the one hand, and heat flowing out into the surroundings, on the other hand. This critical current intensity increases with an increasing motion amplitude, namely the more vigorously the oscillating body moves, the greater the air is swirled in the surroundings of the electromagnets 9 and the more heat is transported away from said electromagnets.

When the control circuit 11 identifies that the current consumption I of the electromagnets 9 is greater than that permitted in the detected oscillating amplitude a, the control circuit 11, as a result of a first simple embodiment, interrupts the current supply to the electromagnets 9 and transmits an error signal to a signal output, not shown in the figure, which may be used in a cooling device in which the linear compressor is installed, in order to actuate an optical or acoustic warning signal generator and thus to make a user aware of a disruption to the device.

As a result of a second embodiment, when a current consumption is established which is too high for the current motion amplitude, the control circuit 11 reduces the amplitude of the sinusoidal voltage or the pulse duty factor of the voltage pulses which are applied to the electromagnets 9 by a predetermined amount or a predetermined factor and subsequently returns to step 1, so that the compressor continues to operate at reduced power. Thus in the case of an overload of the compressor, the power thereof is reduced in a stepwise manner until a level of power is reached, at which damage to the compressor by overheating may be reliably excluded.

Figure 2:
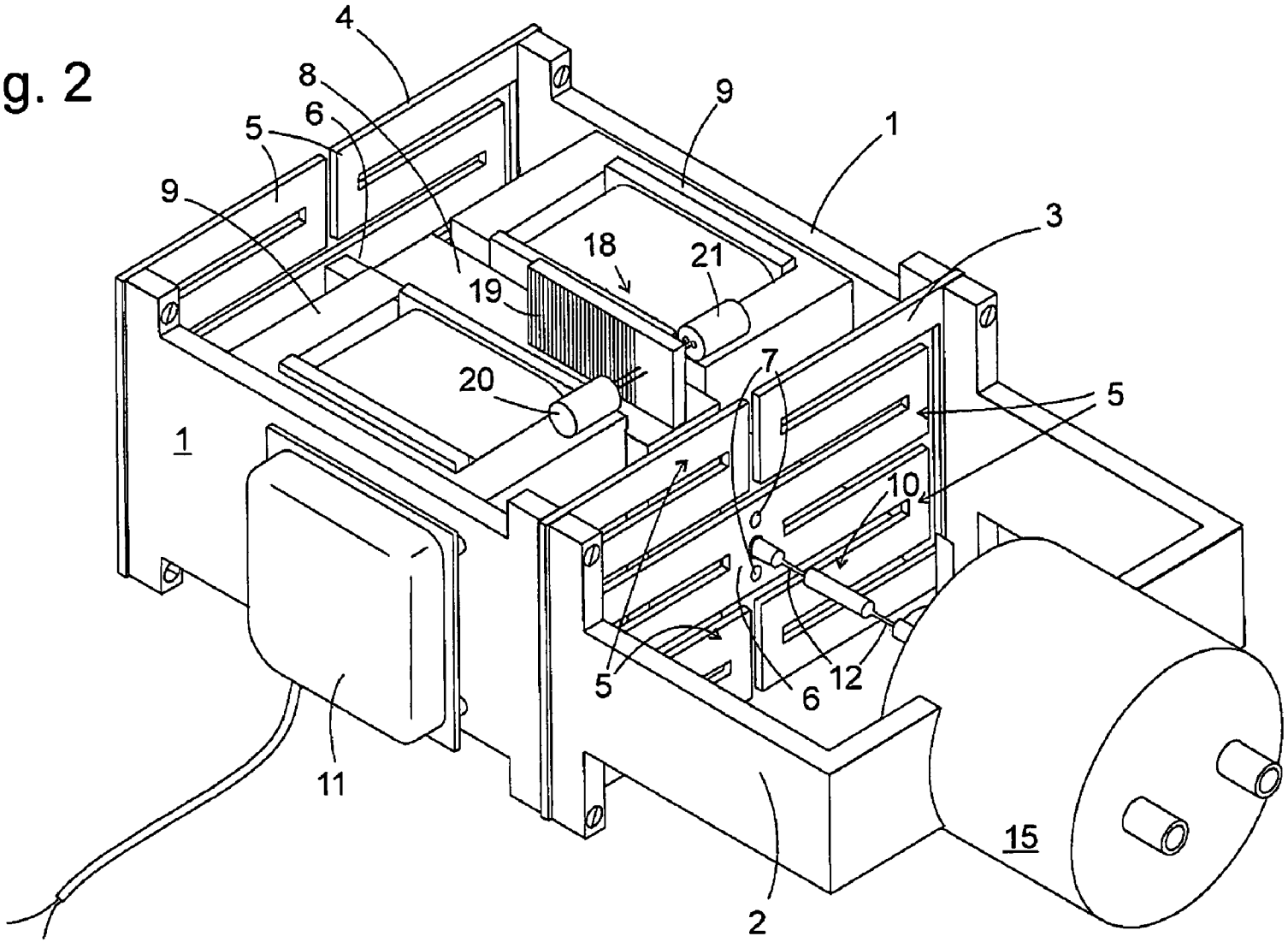
FIG. 2 shows a perspective view of a second embodiment of a linear compressor comprising a control device.

A second characteristic curve stored in the control circuit 11, represented in FIG. 3 as a dashed-dotted line c2, indicates a motion amplitude of the oscillating body 8 which is expected under normal operating conditions as a function of the current consumption I. When the electromagnets 9 are fed with current impulses of uniform voltage and variable pulse duty factor, the curve c2 has an approximately linear path, as shown in FIG. 2; when the stored current is alternating current of variable voltage, the curve has a parabolic path instead. In a fourth step, the control circuit 11 compares whether the current consumption detected at the measured amplitude value, is located above or below the curve c2. If it is located above, this indicates a hindrance to the motion of the oscillating body, i.e. mechanical damage to the linear compressor, so that the control circuit 11 in this case interrupts the power supply to the electromagnets 9 and emits an error signal.

From observing FIG. 3 is may be easily understood that the two characteristic curves c1 and c2 may also be replaced by a single characteristic curve, the path thereof being determined at low amplitudes below a point of intersection of c1 and c2 through c2 and above the point of intersection through c1 so that a comparison only has to be carried out for each pair, consisting of the measured amplitude and measured current intensity, in order to identify whether the compressor is operating normally.

Figure 4:
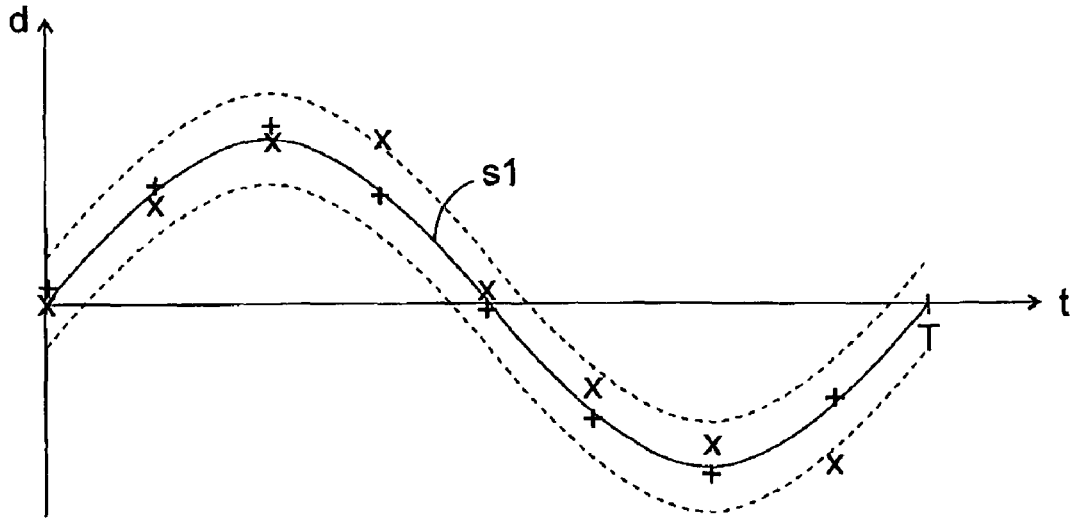
FIG. 4 shows a diagram showing a set motion sequence of the compressor as well as different examples of sets of detected deflections of the compressor.

A second process carried out by the control circuit 11 is explained with reference to FIG. 4. This shows, plotted as a function of the time t, two sets of measured points of the deflection of the oscillating body obtained by means of the position sensor 18, respectively shown by the symbols + and/or x. The measured points are, for example, obtained by generating a sliding average value of the respective deflections measured during the same phase, in this case t=T*i/8, i=0, 1, 2, . . . , 7, T denoting the period of movement of the oscillating body 8. The control circuit 11 monitors the normal function of the linear compressor by adapting a sine curve to the measured points obtained. Thus, for example, in the case of the measured points denoted by +, the sine curve denoted in the diagram by s1 is obtained. All measured points + are located in an interval defined in the figure by dotted sine curves, of predetermined width around the curve s1. In this case, no disruption is identified.

In the case of the measured points denoted by x, the control circuit 11 establishes at the times t=3 T/8 and/or t=7 T/8, that the deflection d is located outside the permitted band width on both sides of the compensating curve s1. The oscillation of the oscillating body 8 over the period T is overlaid by a harmonic oscillation over a half period, which indicates a malfunction. Also in this case, therefore, the control circuit 11 switches off the electromagnets 9 and generates an error signal.

It is not necessary that deflections for all measured points shown in FIG. 3 respectively have to be recorded in a single oscillating period of the oscillating body 8. The time interval between two successive measurements of the deflection may be, for example, (n+m/8) T, n being a small whole number and m=1, 3, 5 or 7.

The invention claimed is:

1. A method for operating a linear compressor comprising the steps of:

providing means for monitoring and detecting current consumption of the linear compressor;

operating the linear compressor;

monitoring and detecting current consumption of the linear compressor during operation thereof using the means for monitoring and detecting current consumption;

determining whether the linear compressor is in an overload state using the detected current consumption; and reducing the motion amplitude of the linear compressor upon a determination that the linear compressor is in an overload state.

2. The method according to claim 1 wherein the step of determining whether the linear compressor is in an overload state includes determining the overload state exists when the detected current consumption of the linear compressor exceeds a first limit value, the first limit value being an increasing function of the motion amplitude.

3. The method according to claim 1 wherein the step of determining whether the linear compressor is in an overload state includes determining the overload state exists when the detected current consumption of the linear compressor falls below a first limit value, the first limit value being an increasing function of the current consumption.

4. The method according to claim 2 wherein, during the step of determining whether the linear compressor is in an overload state, the function is initially established wherein the sum of the heat output released in the linear compressor by the resistance thereof and heat removal from the linear compressor by the motion thereof is substantially constant.

5. The method according to claim 2 wherein at least during the step of operating the linear compressor, a motion amplitude of the linear compressor is reduced to a positive value when the overload state is determined to exist.

6. The method according to claim 1 wherein the step of determining whether the linear compressor is in an overload state includes determining the overload state exists when the motion amplitude falls below a second limit value.

7. The method according to claim 1 wherein step of determining whether an overload condition exists includes detecting deflection of the linear compressor in different phases of the oscillation thereof, and is comparing the deflection with a with a set motion sequence, wherein the overload state is determined to exist when the deviation of the detected deflection from the set motion sequence exceeds a third limit value.

8. The method according to claim 1 wherein the step of reducing the motion amplitude includes reducing the motion amplitude of the linear compressor to zero when the overload state is established.

9. A control device for a linear compressor, comprising a current sensor for detecting the current consumption of the linear compressor and a control circuit for controlling the motion of the linear compressor using the current consumption detected by the current sensor wherein the control circuit is connected to a sensor for detecting the deflection of the linear compressor.

10. The control device according to claim 9 wherein the control circuit is configured for performing the steps of:

monitoring and detecting current consumption of the linear compressor using the means for monitoring and detecting current consumption;

determining using the detected current consumption whether the linear compressor is in an overload state; and reducing the motion amplitude of the linear compressor upon a determination that the linear compressor is in an overload state.

* * * * *